US011156079B2

(12) United States Patent
Alvarez

(10) Patent No.: US 11,156,079 B2
(45) Date of Patent: Oct. 26, 2021

(54) DOWNHOLE TOOL FOR GAS KICK DETECTION AND LIQUID CHARACTERIZATION USING COAXIAL RESONATORS

(71) Applicant: Saudi Arabian Oil Company, Dhahran (SA)

(72) Inventor: Jose Oliverio Alvarez, Houston, TX (US)

(73) Assignee: Saudi Arabian Oil Company, Dhahran (SA)

( * ) Notice: Subject to any disclaimer, the term of this patent is extended or adjusted under 35 U.S.C. 154(b) by 50 days.

(21) Appl. No.: 16/716,241

(22) Filed: Dec. 16, 2019

(65) Prior Publication Data

US 2020/0190970 A1 Jun. 18, 2020

Related U.S. Application Data

(60) Provisional application No. 62/781,345, filed on Dec. 18, 2018.

(51) Int. Cl.
*E21B 47/10* (2012.01)
*E21B 47/13* (2012.01)
*E21B 47/01* (2012.01)

(52) U.S. Cl.
CPC ..... *E21B 47/10* (2013.01); *E21B 47/13* (2020.05); *E21B 47/01* (2013.01)

(58) Field of Classification Search
CPC ..... E21B 47/01; E21B 47/10; E21B 47/113; E21B 47/13
See application file for complete search history.

(56) References Cited

U.S. PATENT DOCUMENTS 3,498,112 A 3/1970 Howard
3,681,684 A 8/1972 Busker et al.
(Continued)

FOREIGN PATENT DOCUMENTS

CN 104632198 A * 5/2015 ..... E21B 47/113
CN 104632198 12/2016
GB 2110377 6/1983

OTHER PUBLICATIONS

GCC Examination Report in Gulf Cooperation Council Appln. No. GC 2019-38845, dated Nov. 8, 2020, 4 pages.
(Continued)

*Primary Examiner* — Caroline N Butcher
(74) *Attorney, Agent, or Firm* — Fish & Richardson P.C.

(57) ABSTRACT

A computer-implemented system includes a downhole tool in a bottom hole assembly attached to a drill string, configured to perform gas measurements during drilling operations. The downhole tool includes a housing to house the downhole tool; sensors positioned along external walls of the housing and including coaxial resonators; electrical circuitry located inside the downhole tool and configured to enable communication by, and operation of, the downhole tool; at least one processor configured to convert scattering parameter 11 signals received from sensors to permittivity values and determine signatures from permittivity values. A memory stores data collected by sensors. A sensor system monitors changes from a baseline signal of drill mud produced during the drilling operations, the changes based at least in part on signatures determined from permittivity values. The downhole tool provides communications to surface systems when a gas kick event is detected by the downhole tool.

20 Claims, 3 Drawing Sheets

(56) References Cited

U.S. PATENT DOCUMENTS

| | | | | |
|---|---|---|---|---|
| 3,815,019 | A | 6/1974 | Wiles | |
| 5,014,010 | A | 5/1991 | Helms | |
| 5,351,521 | A | 10/1994 | Cracknell | |
| 5,455,516 | A | 10/1995 | Buford et al. | |
| 6,534,980 | B2 | 2/2003 | Toufaily et al. | |
| 6,915,707 | B2 * | 7/2005 | Nyfors | G01F 1/40 73/861.63 |
| 7,376,514 | B2 | 5/2008 | Habashy et al. | |
| 7,628,058 | B2 | 12/2009 | Vinci | |
| 8,237,444 | B2 | 8/2012 | Simon | |
| 8,794,062 | B2 | 8/2014 | DiFoggio et al. | |
| 8,884,624 | B2 | 11/2014 | Homan et al. | |
| 8,916,815 | B2 | 12/2014 | Xie et al. | |
| 9,562,987 | B2 | 2/2017 | Guner et al. | |
| 2006/0016592 | A1 | 1/2006 | Wu | |
| 2007/0279073 | A1 | 12/2007 | Wee | |
| 2008/0047337 | A1 | 2/2008 | Chemali et al. | |
| 2010/0270291 | A1 | 10/2010 | Kotzian et al. | |
| 2012/0006430 | A1 | 1/2012 | Gentile et al. | |
| 2013/0110411 | A1 | 5/2013 | Black et al. | |
| 2014/0291023 | A1 | 10/2014 | Edbury | |
| 2016/0334343 | A1 | 11/2016 | Hurlimann et al. | |
| 2017/0077665 | A1 * | 3/2017 | Liu | H01S 1/005 |
| 2017/0131334 | A1 * | 5/2017 | Ramzan | G01N 22/00 |
| 2017/0248530 | A1 | 8/2017 | Parker et al. | |
| 2018/0058207 | A1 * | 3/2018 | Song | E21B 47/005 |

OTHER PUBLICATIONS

U.S. Appl. No. 15/045,362, filed Aug. 18, 2016, Beaman et al.
U.S. Appl. No. 15/397,247, filed Jul. 5, 2018, Soto et al.
"Anton-Paar Pressure Cell Manual," Pressure Cell PR170/Ti/XL and PR170/Ha/XL, Jul. 2017, 34 pages.
Aakre et al., "Conductivity and Permittivity of Midel 7131: Effect of Temperature, Moisture Content, Hydrostatic Pressure and Elextric Field," IEEE Transactions on Dielectrics and Electrical Insulation, vol. 23, No. 5, Oct. 2016, 8 pages.
Carpenter, "Advancing Deepwater Kick Detection", JPT, vol. 68, Issue 5, May 2016, 2 pages.
Garcia-Banos et al., "Non-Invasive Monitoring of Polymer Curing Reactions by Dielectrometry," IEEE Sensors Journal, vol. 11, No. 1, Jan. 2011, 9 pages.
Johnson et al., "Advanced Deepwater Kick Detection," IADC/SPE 167990, presented at the 2014 IADC/SPE Drilling Conference and Exhibition, Mar. 4-6, 2014, 10 pages.
Karimi et al., "Design and Dynamic Characterization of an Orientation Insensitive Microwave Water-Cut Sensor" IEEE Microwave Theory and Technique, Jun. 12, 2017, vol. 66, Issue 1, Jan. 2018, 10 pages.
Oliverio et al., "Dielectric characterization of geochemical properties of erode oils and gas condensate at 25degrees C," 2017 IEEE International Geoscience and Remote Sensing Symposium (IGARSS), IEEE, Jan. 23, 2017, 4 pages.
Olver, "Compact Antenna Test Ranges," Seventh International Conference on Antennas and Propagation IEEE , Apr. 15-18, 1991, 10 pages.
Parini et al., "Chapter 3: Antenna measurements," in Theory and Practice of Modern Antenna Range Measurements, IET editorial, 2014, 30 pages.
petrowiki.org [online], "Kicks," Petrowiki, available on or before Jun. 26, 2015, retrieved on Jan. 24, 2018, retrieved from URL <https://petrowiki.org/Kicks>, 6 pages.
rayoteksightwindows.com [online], "High Pressure Flow Cell Signt Window," available on or before Mar. 2, 2018, retrieved on May 17, 2019, retrieved from URL <https://rayoteksightwindows.com/products/flowcell-sight-glass-windows-en.html>, 1 page.
rigzone.com [online], "How does Well Control Work?" Rigzone, available on or before 1999, retrieved on Jan. 24, 2019, retrieved from URL <https://www.rigzone.com/training/insight.asp?insight_id=304&c_id>, 5 pages.
Stankowski et al., "Microwave resonators for EPR studies at high hydrostatic pressure," Review of Scientific Instruments, vol. 47, No. 1, Jan. 1, 1976, 3 pages.
International Search Report and Written Opinion issued in International Application No. PCT/US2019/066583 dated Mar. 23, 2020, 13 pages.

* cited by examiner

300

DOWNHOLE TOOL FOR GAS KICK DETECTION AND LIQUID CHARACTERIZATION USING COAXIAL RESONATORS

CROSS-REFERENCE TO RELATED APPLICATIONS

This application is a conversion of Provisional Application No. 62/781,345, filed on Dec. 18, 2018, and is hereby incorporated by reference in its entirety.

BACKGROUND

The present disclosure applies to techniques for drilling gas and oil wells. During drilling operations, a drill bit may encounter high-pressurized gas zones. As a result, high-pressurized formation gas can enter the wellbore and travel up to the surface, often expanding during the process. This phenomena is called a "gas kick" (or "getting a kick"). Gas kicks can be related to the control of conditions in a well. For example, providing enough weight on the drill mud can help to keep formation fluids in the formation. In some cases, different mechanisms or processes can be used to deviate gas kicks through alternate routes. For example, if gas kicks are detected in time, such as by watching the levels in the mud tank, then a driller can be informed to shut the annulus of the drill pipe and formation. However, it is more often the case that gas kicks are not detected until it is too late, which can require deployment of an emergency procedure.

Some conventional drilling operations may use techniques such as manage pressure drilling (MPD) and logging while drilling (LWD) tools, including neutron, acoustic logging, and induction tools. MPD systems, for example, can be considered as closed systems based on the principle of balancing the equivalent circulating pressure to the formation pressure. Another technique that is used in drilling operations is a deep-water kick detection (DKD) system. However, DKD systems require many measurements to be feed to the MPD system. Further, the success of such systems can depend on the accuracy of the measurements.

LWD tools may provide information about the changes in density in the drill mud. However, the availability and accuracy of density measurements can be compromised if the drillstring is sliding in a high angle or horizontal borehole. Nuclear magnetic resonance (NMR) LWD tools can be expensive to operate and sensitive to drillstring movements. Acoustic LWD tools can be used in water-based mud (WBM), given the differences in density between water and high-pressurized gas. However, the acoustic LWD tools can present problems and challenges including, for example, eliminating drill noise from the measurements, mounting transmitters and receivers without compromising their reliability, and data processing issues.

Resistivity LWD tools can also be used, but they present limitations regarding kick detection. The resistivity LWD tools can typically use low-frequency signals (for example, 2 megaHertz (MHz)) emitted from a loop antenna in the outside diameter (OD) of the drill collar. The signals can typically exhibit greater unreliability in the wellbores, for example, due to the large wavelength and low-frequency wave signals.

SUMMARY

The present disclosure describes techniques that can be used for drilling gas and oil wells. In some implementations, a computer-implemented system includes a downhole tool included in a bottom hole assembly attached to a drill string. The downhole tool is configured to perform gas measurements during drilling operations using the drill string. The downhole tool includes a housing configured to house the downhole tool. The downhole tool also includes sensors positioned along external walls of the housing. The sensors include coaxial resonators. The downhole tool also includes electrical circuitry located inside the downhole tool. The electrical circuitry is configured to enable communication by, and operation of, the downhole tool. At least one processor converts scattering parameter 11 (S11) signals received from the sensors to permittivity values and determines signatures from the permittivity values. A memory stores data collected by the sensors and values determined by the at least one processor. The downhole tool also includes a sensor system that monitors for changes from a baseline signal of drill mud that is produced during the drilling operations. The changes are based at least in part on the signatures determined from the permittivity values. The downhole tool provides a communication to surface systems when a gas kick event is detected by the downhole tool during the drilling operations.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method/the instructions stored on the non-transitory, computer-readable medium.

The subject matter described in this specification can be implemented in particular implementations, so as to realize one or more of the following advantages. First, high-pressurized gas zones can be identified in real time, such as within a predetermined time period, and remediation actions can be initiated. Second, emergency procedures can be deployed faster by having sensors in a downhole tool to identify gas kicks.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

The following detailed description describes techniques that can be used for drilling gas and oil wells. Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

Figure 1:
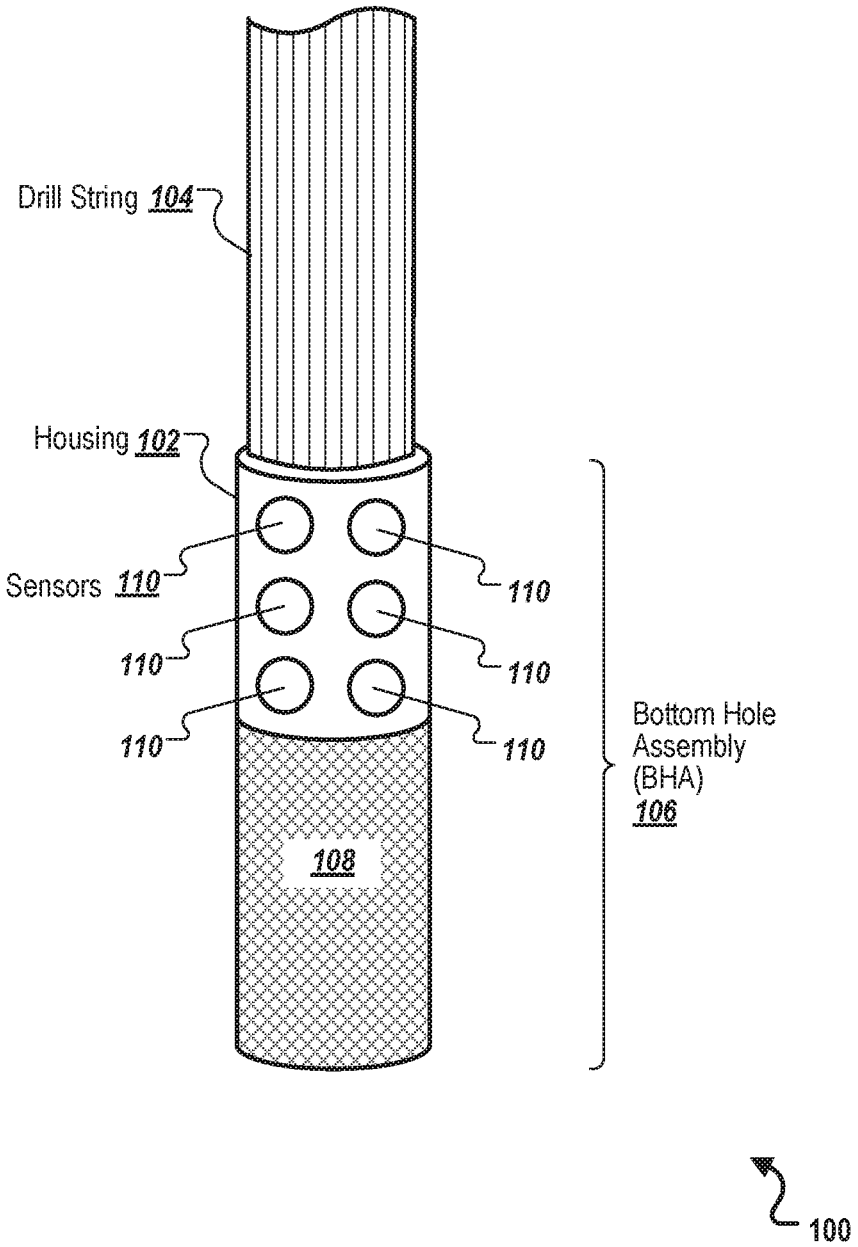
FIG. 1 is a diagram of an example of a downhole tool, according to some implementations of the present disclosure.

FIG. 1 is a diagram of an example of a downhole tool 100, according to some implementations of the present disclosure. The downhole tool 100 includes a metal housing 102 that is cylindrical, for example. The downhole tool 100 can have a diameter, for example, that is typical of other bottom hole assembly (BHA) logging while drilling (LWD) tools. For example, the diameter of the downhole tool 100 can slightly exceed a diameter of a drill string 104 on which the downhole tool 100 is mounted.

The downhole tool 100 can be part of a BHA 106 at the end of the drill string 104. The BHA 106 can extend from a drill bit at the end of the drill pipe (that includes the drill string 104). The BHA 106 can include other BHA components 108 such as drill collars, stabilizers, reamers, shocks, hole-openers, a bit sub, and the drill bit. The tool downhole 100 can be smaller than other BHA tools. For example, the downhole tool 100 can have a length of five to ten feet. The downhole tool 100 can be a rotating or non-rotating tool.

The housing 102 includes sensors 110 on external walls of the housing 102. The sensors 110 can include coaxial probes that have been short-circuited inside to serve as coaxial resonators. A dielectric filling material in the coaxial resonators of the sensors 110 can be made of quartz, or sapphire.

The downhole tool 100 can include electrical circuitry for enabling communication by, and operation of, the downhole tool 100. To support communication functionality of the downhole tool 100, the electrical circuitry can include, for example, a microwave transmitter and a receiver. To support operation of the downhole tool 100, the electrical circuitry can include, for example, a narrowband network analyzer. The narrowband network analyzer can measure one or more parameters (for example, scattering parameter 11 (S11) associated with reflection coefficients) provided by each of the sensors 110. In some implementations, some functions of the electrical circuitry can be performed by systems at the surface of the earth.

A processor in the downhole tool 100 can convert the S11 signal to a permittivity value. The processor can also analyze the permittivity value to determine a signature of the permittivity. The signature of the permittivity can be determined, at least in part, because it is the case that gas has a much smaller permittivity than water and a smaller permittivity than oil.

Each sensor 110 (including the sensor's coaxial resonator) can have a different operating frequency. For example, most or all of the sensors 110 can have different operating frequencies. In some implementations, the frequencies can be optimized through experimentation and laboratory findings in order to produce an optimized overall signal represented by signals of the sensors 110.

A sensor system can control and manage the sensors 110. The sensor system can monitor for changes from a baseline signal of drill mud that is produced during drilling operations. Gas that is encountered or produced can enter the wellbore and can be mixed with the drill mud. Mixing can be increased, for example, from drill pipe rotation and interactions with the drill mud. During the drilling operations, the coaxial resonators of the sensors 110 can detect and identify changes in permittivity that are sensed by the sensors 110 (as determined by the processor).

Data associated with changes in permittivity can be collected in memory (for example, memory inside the downhole tool 100). The collection of the data associated with changes in permittivity can occur (and not immediately communicated to the surface, for example) so as not to interfere with data transmissions of other LWD tools. However, communication regarding data associated with changes in permittivity and signatures exceeding a threshold can be communicated relatively in real-time (within a specified period of time) in some cases. For example, if a gas kick event is detected by the downhole tool 100 during the drilling operation, a signal can be sent through a mud pulse system using a communication priority over other tools' signals. In this way, information regarding a gas kick event can be communicated in real time, giving a drill operator time needed to initiate a kick containment procedure or perform some other action.

Placement of the downhole tool 100 can be upstring or downstring of the BHA 106, depending on the sensitivity of the coaxial resonators. If the downhole tool 100 is placed upstring of the BHA 106, then gas expansion can help with mixing, making it easier to detect permittivity changes. Drill pipe rotation can also help with the mixing. If the downhole tool 100 is placed in the BHA 106, the downhole tool 100 can function independently. The downhole tool 100 can also benefit from assistance provided by a downhole-positioned fixture that increases mixing, for example, by a tortuosity increase (same diameter or uneven diameter) or by the exterior rotating at a rate faster than the drill pipe.

In some implementations, multiple downhole tools 100 can be used. For example, two or more downhole tools 100 can be used simultaneously both in the BHA 106 and upstring of the BHA 106, such as if differential measurements are needed. The downhole tools 100 can use the same frequencies or different frequencies, depending on sensitivity.

The shape of the downhole tool 100 can vary and can depend on specific operations. For example, the downhole tool 100 can be slanted or can have a curved cone shape. Different shapes can also allow the resonators to point in different directions towards the bottom of the well.

Processors that communicate with the downhole tool 100 can have priorities that are based on transmissions that are received. For example, once an event is detected (for example, originating from the downhole tool 100), the downhole tool 100 can receive transmission preference among other transmissions of the drilling operation.

Figure 2:
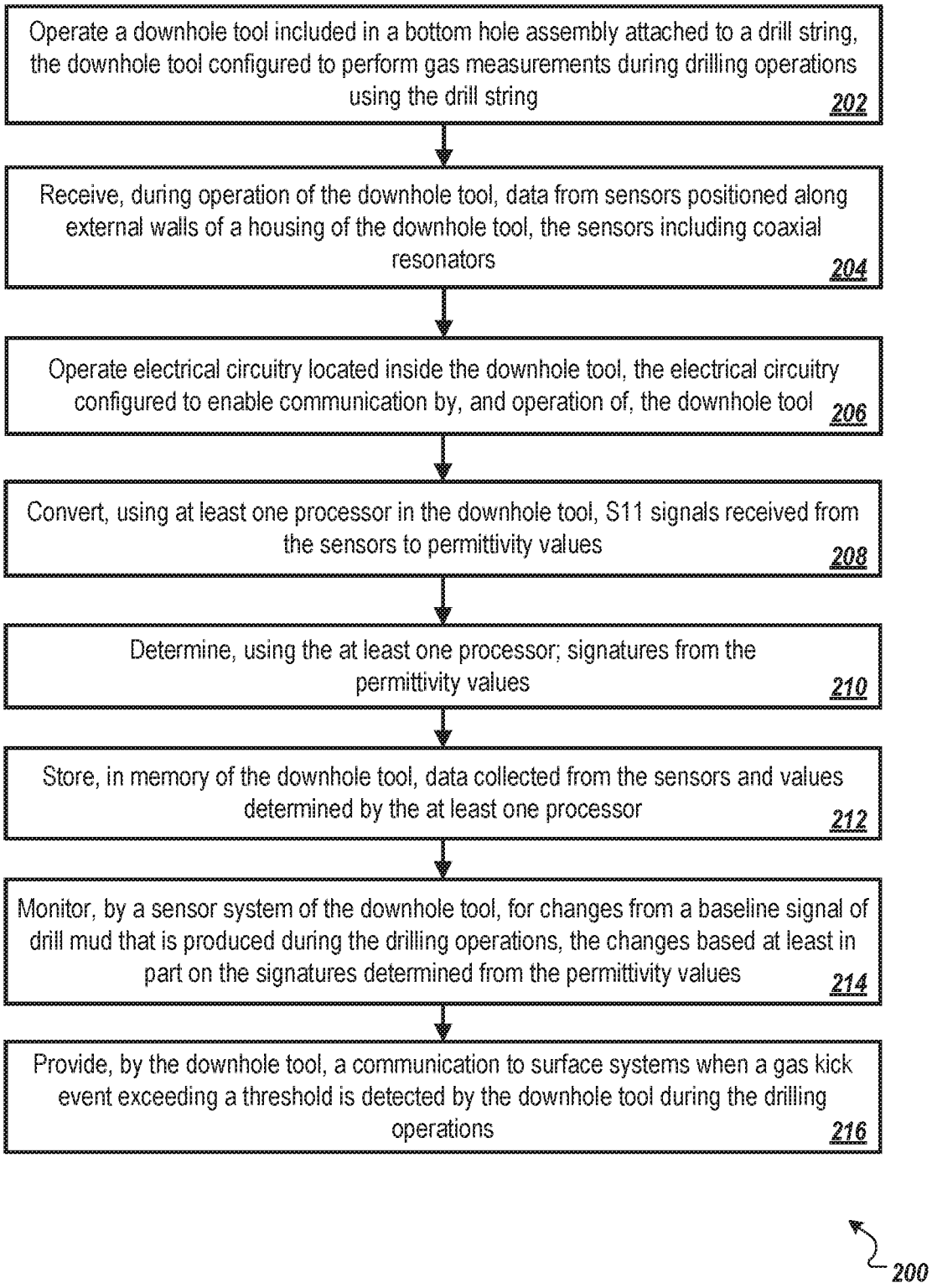
FIG. 2 is a flowchart of an example method for using a downhole tool during drilling operations, according to some implementations of the present disclosure.

FIG. 2 is a flowchart of an example method 200 for using a downhole tool during drilling operations, according to some implementations of the present disclosure. For clarity of presentation, the description that follows generally describes method 200 in the context of the other figures in this description. However, it will be understood that method 200 may be performed, for example, by any suitable system, environment, software, and hardware, or a combination of systems, environments, software, and hardware, as appropriate. In some implementations, various steps of method 200 can be run in parallel, in combination, in loops, or in any order.

At 202, a downhole tool is operated that is included in a bottom hole assembly attached to a drill string. For example, the downhole tool 100 can be configured to perform gas measurements during drilling operations using the drill string 104. The downhole tool 100 can be part of the BHA 106. From 202, method 200 proceeds to 204.

At 204, data from sensors positioned along external walls of a housing of the downhole tool is received during operation of the downhole tool. The sensors include coaxial resonators. For example, the sensors 110 can sense and provide data during drilling operations. From 204, method 200 proceeds to 206.

At 206, electrical circuitry located inside the downhole tool is operated. The electrical circuitry is configured to enable communication by, and operation of, the downhole tool. As an example, the electrical circuitry can include a microwave transmitter and a receiver for communication with systems on a surface of the earth. The electrical circuitry can also include a narrowband network analyzer configured to measure one or more parameters including at least a reflection parameter S11 received by each of the sensors 110. From 206, method 200 proceeds to 208.

At 208, S11 signals received from the sensors are converted to permittivity values using at least one processor in the downhole tool. For example, the sensors 110 can provide signals to the electrical circuitry of the downhole tool 100. The electrical circuitry can convert the signals to permittivity values. From 208, method 200 proceeds to 210.

At 210, signatures are determined from the permittivity values using the at least one processor. For example, the electrical circuitry can convert the permittivity values to signatures. From 210, method 200 proceeds to 212.

At 212, data collected from the sensors and values determined by the at least one processor are stored in memory of the downhole tool. For example, data collected by or determined by the download tool can be stored and not immediately transmitted, so as not to interfere with communications associated with other components of the BHA. From 212, method 200 proceeds to 214.

At 214, monitoring occurs, by a sensor system of the downhole tool, for changes from a baseline signal of drill mud that is produced during the drilling operations. The changes can be based at least in part on the signatures determined from the permittivity values. For example, the monitored changes can be used to determine when a signature indicates that a threshold has been reached that is associated with gas kicks. From 214, method 200 proceeds to 216.

At 216, a communication is provided by the downhole tool to surface systems when a gas kick event exceeding a threshold is detected by the downhole tool during the drilling operations. As an example, when it is detected that the threshold has been reached, the downhole tool can send an alert to an operator of the drilling operation. In some implementations, the alert can appear as a display on a screen. In some implementations, the alert can produce a communication to occur, such as a phone call, a page, or an email. In some implementations, the alert can cause automatic changes in equipment to occur, such as to shut down drilling operations. After 216, method 200 stops.

Figure 3:
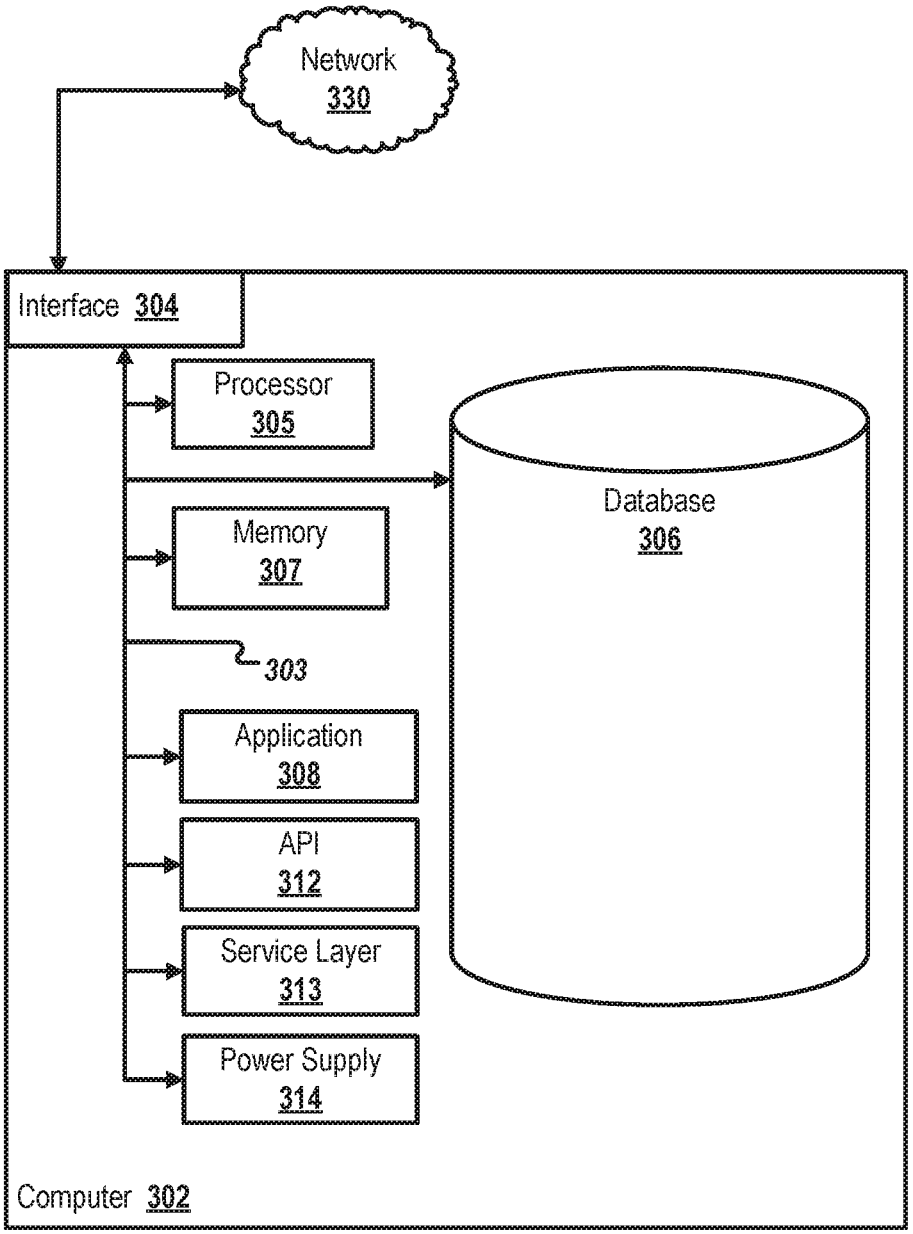
FIG. 3 is a block diagram illustrating an example computer system used to provide computational functionalities associated with described algorithms, methods, functions, processes, flows, and procedures as described in the instant disclosure, according to some implementations of the present disclosure.

FIG. 3 is a block diagram of an example computer system 300 used to provide computational functionalities associated with described algorithms, methods, functions, processes, flows, and procedures, as described in the instant disclosure, according to some implementations of the present disclosure. The illustrated computer 302 is intended to encompass any computing device such as a server, desktop computer, laptop/notebook computer, wireless data port, smart phone, personal data assistant (PDA), tablet computing device, one or more processors within these devices, or any other suitable processing device, including physical or virtual instances (or both) of the computing device. Additionally, the computer 302 can include a computer that includes an input device, such as a keypad, keyboard, or a touch screen that can accept user information, and an output device that conveys information associated with the operation of the computer 302, including digital data, visual, or audio information (or a combination of information), or a graphical-type user interface (UI) (or GUI).

The computer 302 can serve in a role as a client, network component, a server, a database, a persistency, or components of a computer system for performing the subject matter described in the instant disclosure. The illustrated computer 302 is communicably coupled with a network 330. In some implementations, one or more components of the computer 302 may be configured to operate within environments, including cloud-computing-based, local, global, and a combination of environments.

At a high level, the computer 302 is an electronic computing device operable to receive, transmit, process, store, or manage data and information associated with the described subject matter. According to some implementations, the computer 302 may also include or be communicably coupled with an application server, email server, web server, caching server, streaming data server, or a combination of servers.

The computer 302 can receive requests over network 330 from a client application (for example, executing on another computer 302) and respond to the received requests by processing the received requests using an appropriate software application(s). In addition, requests may also be sent to the computer 302 from internal users (for example, from a command console), external or third-parties, automated applications, entities, individuals, systems, or computers.

Each of the components of the computer 302 can communicate using a system bus 303. In some implementations, any or all of the components of the computer 302, hardware or software (or a combination of both hardware and software), may interface with each other or the interface 304 (or a combination of both), over the system bus 303 using an application programming interface (API) 312 or a service layer 313 (or a combination of the API 312 and service layer 313). The API 312 may include specifications for routines, data structures, and object classes. The API 312 may be either computer-language independent or dependent and refer to a complete interface, a single function, or even a set of APIs. The service layer 313 provides software services to the computer 302 and other components (whether or not illustrated) that are communicably coupled to the computer 302. The functionality of the computer 302 may be accessible for all service consumers using this service layer. Software services, such as those provided by the service layer 313, provide reusable, defined functionalities through a defined interface. For example, the interface may be software written in JAVA, C++, or a language providing data in extensible markup language (XML) format. While illustrated as an integrated component of the computer 302, alternative implementations may illustrate the API 312 or the service layer 313 as stand-alone components in relation to other components of the computer 302 and other components communicably coupled to the computer 302. Moreover, any or all parts of the API 312 or the service layer 313 may be implemented as child or sub-modules of another software module, enterprise application, or hardware module without departing from the scope of this disclosure.

The computer 302 includes an interface 304. Although illustrated as a single interface 304 in FIG. 3, two or more interfaces 304 may be used according to particular needs, desires, or particular implementations of the computer 302. The interface 304 is used by the computer 302 for communicating with other systems that are connected to the network 330 (whether illustrated or not) in a distributed environment. Generally, the interface 304 includes logic encoded in software or hardware (or a combination of software and hardware) and is operable to communicate with the network 330. More specifically, the interface 304 can include software supporting one or more communication protocols associated with communications such that the network 330 or interface's hardware is operable to communicate physical signals within and outside of the illustrated computer 302.

The computer 302 includes a processor 305. Although illustrated as a single processor 305 in FIG. 3, two or more processors may be used according to particular needs, desires, or particular implementations of the computer 302. Generally, the processor 305 executes instructions and manipulates data to perform the operations of the computer 302 and any algorithms, methods, functions, processes, flows, and procedures as described in the instant disclosure.

The computer 302 also includes a database 306 that can hold data for the computer 302 and other components connected to the network 330 (whether illustrated or not). For example, database 306 can be an in-memory, conventional, or a database storing data consistent with this disclosure. In some implementations, database 306 can be a combination of two or more different database types (for example, a hybrid in-memory and conventional database) according to particular needs, desires, or particular implementations of the computer 302 and the described functionality. Although illustrated as a single database 306 in FIG. 3, two or more databases (of the same or combination of types) can be used according to particular needs, desires, or particular implementations of the computer 302 and the described functionality. While database 306 is illustrated as an integral component of the computer 302, in alternative implementations, database 306 can be external to the computer 302.

The computer 302 also includes a memory 307 that can hold data for the computer 302 or a combination of components connected to the network 330 (whether illustrated or not). Memory 307 can store any data consistent with this disclosure. In some implementations, memory 307 can be a combination of two or more different types of memory (for example, a combination of semiconductor and magnetic storage) according to particular needs, desires, or particular implementations of the computer 302 and the described functionality. Although illustrated as a single memory 307 in FIG. 3, two or more memories 307 (of the same or combination of types) can be used according to particular needs, desires, or particular implementations of the computer 302 and the described functionality. While memory 307 is illustrated as an integral component of the computer 302, in alternative implementations, memory 307 can be external to the computer 302.

The application 308 is an algorithmic software engine providing functionality according to particular needs, desires, or particular implementations of the computer 302, particularly with respect to functionality described in this disclosure. For example, application 308 can serve as one or more components, modules, or applications. Further, although illustrated as a single application 308, the application 308 may be implemented as multiple applications 308 on the computer 302. In addition, although illustrated as integral to the computer 302, in alternative implementations, the application 308 can be external to the computer 302.

The computer 302 can also include a power supply 314. The power supply 314 can include a rechargeable or non-rechargeable battery that can be configured to be either user- or non-user-replaceable. In some implementations, the power supply 314 can include power-conversion or management circuits (including recharging, standby, or a power management functionality). In some implementations, the power-supply 314 can include a power plug to allow the computer 302 to be plugged into a wall socket or a power source to, for example, power the computer 302 or recharge a rechargeable battery.

There may be any number of computers 302 associated with, or external to, a computer system containing computer 302, each computer 302 communicating over network 330. Further, the term "client," "user," and other appropriate terminology may be used interchangeably, as appropriate, without departing from the scope of this disclosure. Moreover, this disclosure contemplates that many users may use one computer 302, or that one user may use multiple computers 302.

Described implementations of the subject matter can include one or more features, alone or in combination.

For example, in a first implementation, a computer-implemented system includes a downhole tool included in a bottom hole assembly attached to a drill string. The downhole tool is configured to perform gas measurements during drilling operations using the drill string. The downhole tool includes a housing configured to house the downhole tool. The downhole tool also includes sensors positioned along external walls of the housing. The sensors include coaxial resonators. The downhole tool also includes electrical circuitry located inside the downhole tool. The electrical circuitry is configured to enable communication by, and operation of, the downhole tool. At least one processor converts S11 signals received from the sensors to permittivity values and determines signatures from the permittivity values. A memory stores data collected by the sensors and values determined by the at least one processor. The downhole tool also includes a sensor system that monitors for changes from a baseline signal of drill mud that is produced during the drilling operations. The changes are based at least in part on the signatures determined from the permittivity values. The downhole tool provides a communication to surface systems when a gas kick event is detected by the downhole tool during the drilling operations.

The foregoing and other described implementations can each, optionally, include one or more of the following features:

A first feature, combinable with any of the following features, where the downhole tool has a length of between five and ten feet.

A second feature, combinable with any of the previous or following features, where dielectric filling material of the coaxial resonators includes one or more of quartz or sapphire.

A third feature, combinable with any of the previous or following features, where the electrical circuitry includes a microwave transmitter and a receiver for communication with systems on a surface of the earth.

A fourth feature, combinable with any of the previous or following features, where the electrical circuitry includes narrowband network analyzer configured to measure one or more parameters including at least a reflection parameter S11 received by each of the sensors.

A fifth feature, combinable with any of the previous or following features, where the downhole tool is a rotating tool or a non-rotating tool.

A sixth feature, combinable with any of the previous or following features, where each sensor has a different operating frequency.

In a second implementation, a computer-implemented method includes operating a downhole tool included in a bottom hole assembly attached to a drill string. The downhole tool is configured to perform gas measurements during drilling operations using the drill string. During operation of the downhole tool, data is received from sensors positioned along external walls of a housing of the downhole tool. The sensors include coaxial resonators. Electrical circuitry located inside the downhole tool is operated. The electrical circuitry is configured to enable communication by, and operation of, the downhole tool. Using at least one processor in the downhole tool, S11 signals received from the sensors are converted to permittivity values. Signatures are determined from the permittivity values. Data collected from the sensors and values determined by the at least one processor are stored in memory of the downhole tool. A sensor system of the downhole tool monitors for changes from a baseline signal of drill mud that is produced during the drilling operations. The changes are based, at least in part, on the signatures determined from the permittivity values. The downhole tool provides a communication to surface systems when a gas kick event exceeding a threshold is detected by the downhole tool during the drilling operations.

The foregoing and other described implementations can each, optionally, include one or more of the following features:

A first feature, combinable with any of the following features, where the downhole tool has a length of between five and ten feet.

A second feature, combinable with any of the following features, where dielectric filling material of the coaxial resonators includes one or more of quartz or sapphire.

A third feature, combinable with any of the following features, where the electrical circuitry includes a microwave transmitter and a receiver for communication with systems on a surface of the earth.

A fourth feature, combinable with any of the following features, where the electrical circuitry includes narrowband network analyzer configured to measure one or more parameters including at least a reflection parameter S11 received by each of the sensors.

A fifth feature, combinable with any of the following features, where the downhole tool is a rotating tool or a non-rotating tool.

A sixth feature, combinable with any of the following features, where each sensor has a different operating frequency.

In a third implementation, a non-transitory, computer-readable medium stores one or more instructions executable by a computer system to perform operations for operating a downhole tool included in a bottom hole assembly attached to a drill string. The downhole tool is configured to perform gas measurements during drilling operations using the drill string. During operation of the downhole tool, data is received from sensors positioned along external walls of a housing of the downhole tool. The sensors include coaxial resonators. Electrical circuitry located inside the downhole tool is operated. The electrical circuitry is configured to enable communication by, and operation of, the downhole tool. Using at least one processor in the downhole tool, S11 signals received from the sensors are converted to permittivity values. Signatures are determined from the permittivity values. Data collected from the sensors and values determined by the at least one processor are stored in memory of the downhole tool. A sensor system of the downhole tool monitors for changes from a baseline signal of drill mud that is produced during the drilling operations. The changes are based, at least in part, on the signatures determined from the permittivity values. The downhole tool provides a communication to surface systems when a gas kick event exceeding a threshold is detected by the downhole tool during the drilling operations.

The foregoing and other described implementations can each, optionally, include one or more of the following features:

A first feature, combinable with any of the following features, where the downhole tool has a length of between five and ten feet.

A second feature, combinable with any of the following features, where dielectric filling material of the coaxial resonators includes one or more of quartz or sapphire.

A third feature, combinable with any of the following features, where the electrical circuitry includes a microwave transmitter and a receiver for communication with systems on a surface of the earth.

A fourth feature, combinable with any of the following features, where the electrical circuitry includes narrowband network analyzer configured to measure one or more parameters including at least a reflection parameter S11 received by each of the sensors.

A fifth feature, combinable with any of the following features, where the downhole tool is a rotating tool or a non-rotating tool.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs, that is, one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal, for example, a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," or "electronic computer device" (or equivalent as understood by one of ordinary skill in the art) refer to data processing hardware and encompass all kinds of apparatus, devices, and machines for processing data, including by way of example, a programmable processor, a computer, or multiple processors or computers. The apparatus can also be, or further include, special purpose logic circuitry. Circuitry can include, for example, a central processing unit (CPU), a field programmable gate array (FPGA), or an application-specific integrated circuit (ASIC). In some implementations, the data processing apparatus or special purpose logic circuitry (or a combination of the data processing apparatus or special purpose logic circuitry) may be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, LINUX, UNIX, WINDOWS, MAC OS, ANDROID, or IOS.

A computer program, which may also be referred to or described as a program, software, a software application, a module, a software module, a script, or code can be written in any form of programming language, including compiled or interpreted languages, or declarative or procedural languages, and it can be deployed in any form, including as a stand-alone program or as a module, component, subroutine, or a unit for use in a computing environment. A computer program may, but need not, correspond to a file in a file system. A program can be stored in a portion of a file that holds other programs or data, for example, one or more scripts stored in a markup language document, in a single file dedicated to the program in question, or in multiple coordinated files, for example, files that store one or more modules, sub-programs, or portions of code. A computer program can be deployed to be executed on one computer or on multiple computers that are located at one site or distributed across multiple sites and interconnected by a communication network. While portions of the programs illustrated in the various figures are shown as individual modules that implement the various features and functionality through various objects, methods, or processes, the programs may instead include a number of sub-modules, third-party services, components, libraries, and such, as appropriate. Conversely, the features and functionality of various components can be combined into single components, as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on general or special purpose microprocessors, or both. Generally, a CPU will receive instructions and data from and write to a memory. The essential elements of a computer are a CPU, for performing or executing instructions, and one or more memory devices for storing instructions and data. Generally, a computer will also include, or be operatively coupled to, receive data from or transfer data to, or both, one or more mass storage devices for storing data, for example, magnetic, magneto-optical disks, or optical disks. However, a computer need not have such devices. Moreover, a computer can be embedded in another device, for example, a mobile telephone, a personal digital assistant (PDA), a mobile audio or video player, a game console, a global positioning system (GPS) receiver, or a portable storage device, for example, a universal serial bus (USB) flash drive, to name just a few.

Computer-readable media (transitory or non-transitory, as appropriate) suitable for storing computer program instructions and data includes all forms of permanent/non-permanent or volatile/non-volatile memory, media and memory devices, including by way of example semiconductor memory devices, for example, random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices; magnetic devices, for example, tape, cartridges, cassettes, internal/removable disks; magneto-optical disks; and optical memory devices, for example, digital video disc (DVD), CD-ROM, DVD+/−R, DVD-RAM, DVD-ROM, HD-DVD, and BLURAY. The memory may store various objects or data, including caches, classes, frameworks, applications, modules, backup data, jobs, web pages, web page templates, data structures, database tables, repositories storing dynamic information, including parameters, variables, algorithms, instructions, rules, constraints, and references. Additionally, the memory may include logs, policies, security or access data, and reporting files. The processor and the memory can be supplemented by, or incorporated in, special purpose logic circuitry.

To provide for interaction with a user, implementations of the subject matter described in this specification can be implemented on a computer having a display device, for example, a cathode ray tube (CRT), liquid crystal display (LCD), light-emitting diode (LED), or plasma monitor, for displaying information to the user and a keyboard and a pointing device, for example, a mouse, trackball, or trackpad by which the user can provide input to the computer. Input may also be provided to the computer using a touchscreen, such as a tablet computer surface with pressure sensitivity, a multi-touch screen using capacitive or electric sensing. Devices can be used to provide for interaction with a user. Feedback provided to the user can be any form of sensory feedback, for example, visual feedback, auditory feedback, or tactile feedback. Input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

The term "graphical user interface," or "GUI," may be used in the singular or the plural to describe one or more graphical user interfaces and each of the displays of a particular graphical user interface. Therefore, a GUI may represent any graphical user interface, including but not limited to, a web browser, a touch screen, or a command line interface (CLI) that processes information and efficiently presents the information results to the user. In general, a GUI may include a plurality of user interface (UI) elements, some or all associated with a web browser, such as interactive fields, pull-down lists, and buttons. UI elements may be related to or represent the functions of the web browser.

Implementations of the subject matter described in this specification can be implemented in a computing system that includes a back-end component, for example, as a data server, or that includes a middleware component, for example, an application server, or that includes a front-end component, for example, a client computer having a graphical user interface or a Web browser through which a user can interact with some implementations of the subject matter described in this specification, or any combination of one or more such back-end, middleware, or front-end components. The components of the system can be interconnected by any form or medium of wireline or wireless digital data communication (or a combination of data communication), for example, a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) using, for example, 802.11 a/b/g/n or 802.20 (or a combination of 802.11x and 802.20 protocols), all or a portion of the Internet, communication systems at one or more locations, or a combination of communication networks. The network may communicate with, for example, Internet Protocol (IP) packets, Frame Relay frames, Asynchronous Transfer Mode (ATM) cells, voice, video, data, or a combination of communication types between network addresses.

The computing system can include clients and servers. A client and server are generally remote from each other and typically interact through a communication network. The relationship of client and server arises by virtue of computer programs running on the respective computers and having a client-server relationship to each other.

Cluster file systems can be any file system type accessible from multiple servers for read and update. Locking or consistency tracking may not be necessary since the locking of exchange file system can be done at application layer. Furthermore, Unicode data files are different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain this disclosure. Other changes, substitutions, and alterations are also possible without departing from the spirit and scope of this disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. A computer-implemented system, comprising:

a downhole tool included in a bottom hole assembly attached to a drill string, the downhole tool configured to perform gas measurements during drilling operations using the drill string;

wherein the downhole tool comprises:

a housing configured to house the downhole tool;

sensors positioned along external walls of the housing, the sensors including coaxial resonators;

electrical circuitry located inside the downhole tool, the electrical circuitry configured to enable communication by, and operation of, the downhole tool;

at least one processor configured to convert scattering parameter 11 (S11) signals received from the sensors to permittivity values and determine signatures from the permittivity values;

a memory for storing data collected by the sensors and values determined by the at least one processor; and a sensor system that monitors for changes from a baseline signal of drill mud that is produced during the drilling operations, the changes based at least in part on the signatures determined from the permittivity values;

wherein the downhole tool provides a communication to surface systems when a gas kick event is detected by the downhole tool during the drilling operations, wherein detecting the gas kick event includes detecting, during operation of the downhole tool, a high-pressurized gas zone having a pressure exceeding a threshold pressure, and wherein providing the communication includes providing a high-priority communication having a higher communication priority than communication priorities of signals of tools other than the sensor system.

2. The computer-implemented system of claim 1, wherein the downhole tool has a length of between five and ten feet.

3. The computer-implemented system of claim 1, wherein dielectric filling material of the coaxial resonators includes one or more of quartz or sapphire.

4. The computer-implemented system of claim 1, wherein the electrical circuitry includes a microwave transmitter and a receiver for communication with systems on a surface of the earth.

5. The computer-implemented system of claim 1, wherein the electrical circuitry includes narrowband network analyzer configured to measure one or more parameters including at least a reflection parameter S11 received by each of the sensors.

6. The computer-implemented system of claim 1, wherein the downhole tool is a rotating tool.

7. The computer-implemented system of claim 1, wherein each sensor has a different operating frequency.

8. A computer-implemented method, comprising:

operating a downhole tool included in a bottom hole assembly attached to a drill string, the downhole tool configured to perform gas measurements during drilling operations using the drill string;

receiving, during operation of the downhole tool, data from sensors positioned along external walls of a housing of the downhole tool, the sensors including coaxial resonators;

operating electrical circuitry located inside the downhole tool, the electrical circuitry configured to enable communication by, and operation of, the downhole tool;

converting, using at least one processor in the downhole tool, S11 signals received from the sensors to permittivity values;

determining, using at least one processor; signatures from the permittivity values;

storing, in memory of the downhole tool, data collected from the sensors and values determined by the at least one processor;

monitoring, by a sensor system of the downhole tool, for changes from a baseline signal of drill mud that is produced during the drilling operations, the changes based at least in part on the signatures determined from the permittivity values; and providing, by the downhole tool, a communication to surface systems when a gas kick event exceeding a threshold is detected by the downhole tool during the drilling operations, wherein detecting the gas kick event includes detecting, during operation of the downhole tool, a high-pressurized gas zone having a pressure exceeding a threshold pressure, and wherein providing the communication includes providing a high-priority communication having a higher communication priority than communication priorities of signals of tools other than the sensor system.

9. The computer-implemented method of claim 8, wherein the downhole tool has a length of between five and ten feet.

10. The computer-implemented method of claim 8, wherein dielectric filling material of the coaxial resonators includes one or more of quartz or sapphire.

11. The computer-implemented method of claim 8, wherein the electrical circuitry includes a microwave transmitter and a receiver for communication with systems on a surface of the earth.

12. The computer-implemented method of claim 8, wherein the electrical circuitry includes narrowband network analyzer configured to measure one or more parameters including at least a reflection parameter S11 received by each of the sensors.

13. The computer-implemented method of claim 8, wherein the downhole tool is a rotating tool.

14. The computer-implemented method of claim 8, wherein each sensor has a different operating frequency.

15. A non-transitory, computer-readable medium storing one or more instructions executable by a computer system to perform operations comprising:

operating a downhole tool included in a bottom hole assembly attached to a drill string, the downhole tool configured to perform gas measurements during drilling operations using the drill string;

receiving, during operation of the downhole tool, data from sensors positioned along external walls of a housing of the downhole tool, the sensors including coaxial resonators;

operating electrical circuitry located inside the downhole tool, the electrical circuitry configured to enable communication by, and operation of, the downhole tool;

converting, using at least one processor in the downhole tool, S11 signals received from the sensors to permittivity values;

determining, using at least one processor; signatures from the permittivity values;

storing, in memory of the downhole tool, data collected from the sensors and values determined by the at least one processor;

monitoring, by a sensor system of the downhole tool, for changes from a baseline signal of drill mud that is produced during the drilling operations, the changes based at least in part on the signatures determined from the permittivity values; and providing, by the downhole tool, a communication to surface systems when a gas kick event exceeding a threshold is detected by the downhole tool during the drilling operations, wherein detecting the gas kick event includes detecting, during operation of the downhole tool, a high-pressurized gas zone having a pressure exceeding a threshold pressure, and wherein providing the communication includes providing a high-priority communication having a higher communication priority than communication priorities of signals of tools other than the sensor system.

16. The non-transitory, computer-readable medium of claim 15, wherein the downhole tool has a length of between five and ten feet.

17. The non-transitory, computer-readable medium of claim 15, wherein dielectric filling material of the coaxial resonators includes one or more of quartz or sapphire.

18. The non-transitory, computer-readable medium of claim 15, wherein the electrical circuitry includes a microwave transmitter and a receiver for communication with systems on a surface of the earth.

19. The non-transitory, computer-readable medium of claim 15, wherein the electrical circuitry includes narrowband network analyzer configured to measure one or more parameters including at least a reflection parameter S11 received by each of the sensors.

20. The non-transitory, computer-readable medium of claim 15, wherein the downhole tool is a rotating tool.

* * * * *